US008413399B2

(12) United States Patent
Kelley, Jr.

(10) Patent No.: US 8,413,399 B2
(45) Date of Patent: Apr. 9, 2013

(54) BLOCK COMBINABLE WITH OTHER SIMILAR BLOCKS TO FORM A WALL, AND RELATED SYSTEMS AND METHODS

(76) Inventor: Michael L. Kelley, Jr., Edgewood, WA (US)

( * ) Notice: Subject to any disclaimer, the term of this patent is extended or adjusted under 35 U.S.C. 154(b) by 333 days.

(21) Appl. No.: 12/658,413

(22) Filed: Feb. 10, 2010

(65) Prior Publication Data

US 2011/0192097 A1 Aug. 11, 2011

(51) Int. Cl.
*E04B 2/08* (2006.01)
*E04B 2/18* (2006.01)
*E04B 2/20* (2006.01)

(52) U.S. Cl. ..... 52/562; 52/563; 52/564; 52/565; 52/569; 52/604; 52/605; 52/606; 52/607; 405/262; 405/284; 405/286

(58) Field of Classification Search ..... 52/503–505, 52/596–612, 782.1, 125.1–125.5, 122.1, 52/124.2, 98, 561–572, 699, 712, 707–708; 405/262, 284; 249/98, 142, 151, 160, 177; 108/51.11, 53.1, 53.3
See application file for complete search history.

(56) References Cited

U.S. PATENT DOCUMENTS 5,402,609 A * 4/1995 Kelley, Jr. ..... 52/98
5,651,642 A 7/1997 Kelley, Jr. et al.
5,667,200 A * 9/1997 Kelley, Jr. ..... 264/219
5,816,749 A * 10/1998 Bailey, II ..... 405/286
6,019,550 A * 2/2000 Wrigley et al. ..... 405/262
6,071,041 A * 6/2000 Knight ..... 405/16
6,612,784 B2 * 9/2003 Rainey et al. ..... 405/284
7,096,635 B2 * 8/2006 Price et al. ..... 52/604
7,472,520 B2 * 1/2009 Everett et al. ..... 52/220.2
2005/0069389 A1 * 3/2005 Shaw ..... 405/286
2006/0207206 A1 * 9/2006 Everett et al. ..... 52/604
2007/0234665 A1 * 10/2007 Price ..... 52/311.1
2009/0113836 A1 * 5/2009 Pitchers et al. ..... 52/604
2009/0142145 A1 * 6/2009 Martin ..... 405/303
2009/0304459 A1 12/2009 Macdonald et al.

OTHER PUBLICATIONS

Tensar Corp., Sales Brochure titled, "Mesa Plateau Retaining Wall System," Copyright 2006, 8 pages, USA.
Tensar Corp., Sales Brochure titled, "Mesa Ashford Retaining Wall System," Copyright 2006, 8 pages, USA.
Tanex, "Tanex T-Block Retaining Wall System," Copyright 1995-2009, webpage <http://www.tanex.net/geosynthetics/products.htm>, USA.

* cited by examiner

*Primary Examiner* — Jeanette E. Chapman
(74) *Attorney, Agent, or Firm* — Janeway Patent Law PLLC; John M. Janeway

(57) ABSTRACT

A block combinable with other similar blocks to form a wall comprises a front surface; a top surface including a plurality of bosses, two or more of which are located adjacent each other in a direction along the front surface; and a bottom surface including a groove that has a floor. Each of the two or more bosses of the top surface includes a summit, and the summit of each define a plane. When the block is placed on another similar block such that the bottom surface of the block and a top surface of the other similar block oppose each other to form an interface region, the groove holds two or more bosses of the other similar block that are included in the other similar block's top surface, and the floor does not intersect the plane defined by the two or more bosses of the other similar block.

8 Claims, 5 Drawing Sheets

BLOCK COMBINABLE WITH OTHER SIMILAR BLOCKS TO FORM A WALL, AND RELATED SYSTEMS AND METHODS

BACKGROUND

Many retaining walls—walls constructed to prevent soil, rock and/or other materials from moving to an undesired location—now include a geogrid coupled to the wall that extends into the soil, rock and/or other materials to help retain the materials. Frequently, such retaining walls are constructed from blocks that are placed on top of each other. With the use of such blocks, one has a great degree of flexibility in the final design of the wall, such as the height of the wall, the length of the wall, and the curvature of the wall. The geogrid frequently coupled to such walls is typically a screen mesh made of plastic rods that intersect each other (typically at 90°) and are spaced apart as desired to provide the desired support for the average particulate size of the material retained by the wall.

To couple the geogrid to the wall, a portion of the geogrid is typically placed between two or more blocks of the wall and held between the blocks by friction between the geogrid and the blocks. For example, FIG. 1 shows a perspective, partial cut-away view of a conventional retaining wall 20 that has a geogrid 22 coupled to it. The wall 20 includes a plurality of blocks 24 stacked on top of each other. To couple the geogrid 22 to the wall 20, a portion of the geogrid 26 is inserted between some of the blocks 24. The geogrid 22 is held in place by the friction between the geogrid portion 26 and the blocks 24 above the portion 26 and the blocks 24 below the portion 26

Unfortunately, coupling the geogrid 22 to the wall 20 in this manner often doesn't secure the geogrid 20 to the wall 20 well enough. If a moderate amount of pressure is exerted on the geogrid in the direction shown by the arrow 28, or exerted on the wall 20 in the direction shown by the arrow 30, the portion 26 of the geogrid 22 may move relative to the blocks 24 immediately above and below the portion 26. This may be especially true when the wall 20 is short in height, because with such a wall the friction between the portion 26 and the blocks 24 is significantly reduced relative to a taller wall. The friction is significantly reduced because the amount of weight provided by the blocks 24 above the portion 26 of the geogrid 22 is much less for a short wall relative to a tall wall.

SUMMARY

In one aspect of the invention, a block that can be combined with other similar blocks to form a wall comprises a front surface; a top surface including a plurality of bosses, two or more of which are located adjacent each other in a direction along the front surface; and a bottom surface including a groove that has a floor. Each of the two or more bosses of the top surface includes a summit, and the summit of each define a plane. When the block is placed on another similar block such that the bottom surface of the block and a top surface of the other similar block oppose each other to form an interface region, the groove holds two or more bosses of the other similar block that are included in the other similar block's top surface, and the floor does not intersect the plane defined by the two or more bosses of the other similar block.

With the bosses 52 held by the groove 56, the force generated by friction between the geogrid 42 and the block 44 that includes the groove 56, and by friction between the geogrid 42 and the other block 44 that includes the bosses 52, is greater than the force generated by friction between the geogrid 22 (FIG. 1) and the conventional blocks 24 (FIG. 1). Because the force generated by friction opposes movement of the geogrid relative to the blocks 44, as the force increases it becomes more difficult for the geogrid to be uncoupled from the wall 40. And with the floor of the groove 56 not intersecting the plane defined by the summits of the bosses 52, more of the geogrid 42 that is placed between the blocks 44 contacts the blocks 44 to generate friction. Furthermore, the geogrid 42 can be disposed between a groove 56 of one block 44 and the boss 52 of another block 44 and remain flat (not curve to form a bump or mound) as the geogrid 42 extends away from the blocks 44.

In another aspect of the invention, a block that can be combined with other similar blocks to form a wall comprises a top surface having an anterior region that includes a boss, and a posterior region that includes a slot, a bottom surface having an anterior region that includes a receptacle, and a coupler to couple a geogrid to the block. When the block is placed on another similar block such that the bottom surface of the block and the top surface of the other similar block oppose each other to form an interface region, the receptacle holds a boss of the other similar block's top surface. To couple a geogrid to the block, a portion of the coupler is inserted through a portion of the geogrid and then into the slot in the posterior region of the top surface.

With the coupler inserted into the slot, the geogrid can be coupled to a block without generating friction between the geogrid and the block.

DETAILED DESCRIPTION

Figure 2:
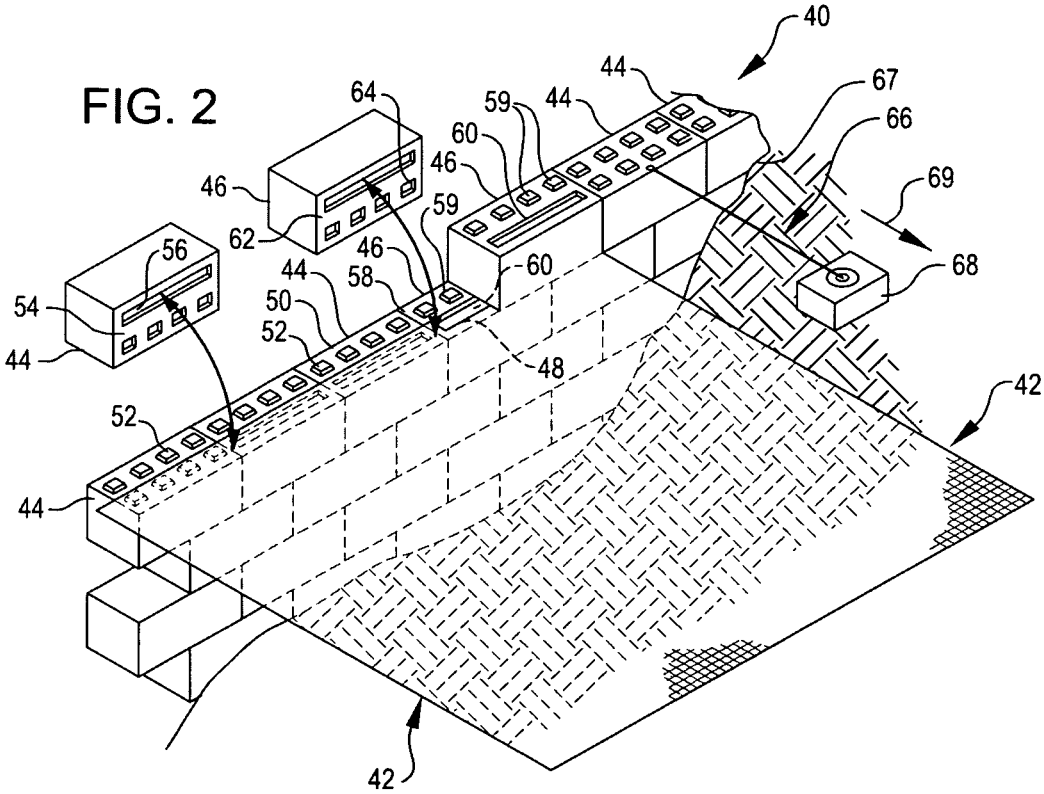
FIG. 2 is a perspective, partial cut away view of a wall and a geogrid coupled to the wall, according to an embodiment of the invention.
Figure 9:
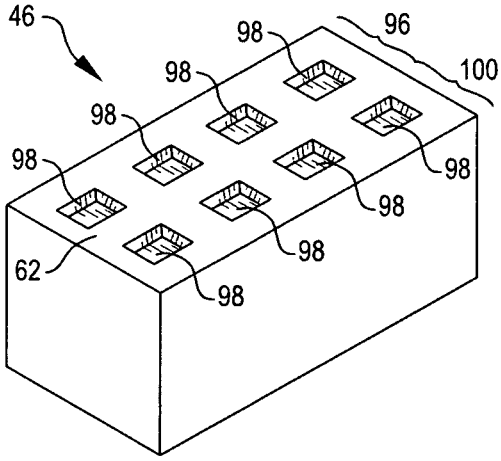
FIG. 9 is a perspective view of a block similar to the block shown in FIG. 7, according to yet another embodiment of the invention.
Figure 10:
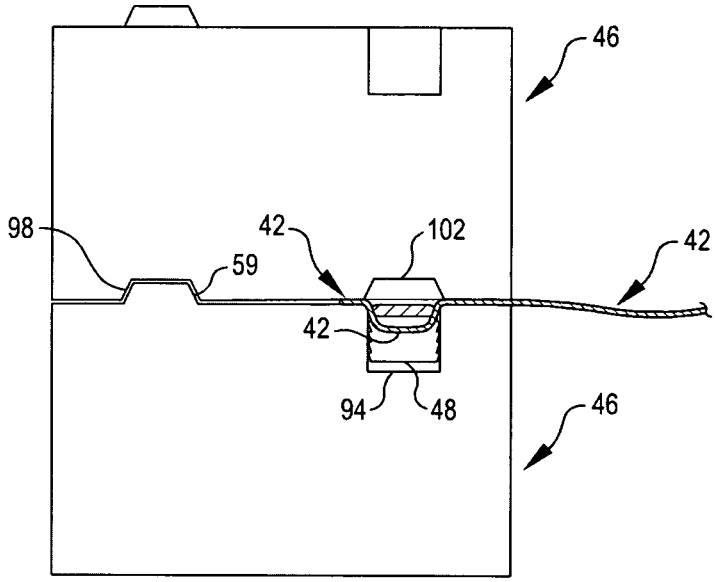
FIG. 10 is a cross-sectional view of a portion of the wall shown in FIG. 2, illustrating two blocks each shown in FIGS. 7 and 8, and a geogrid coupled to them, according to another embodiment of the invention.
Figure 11:
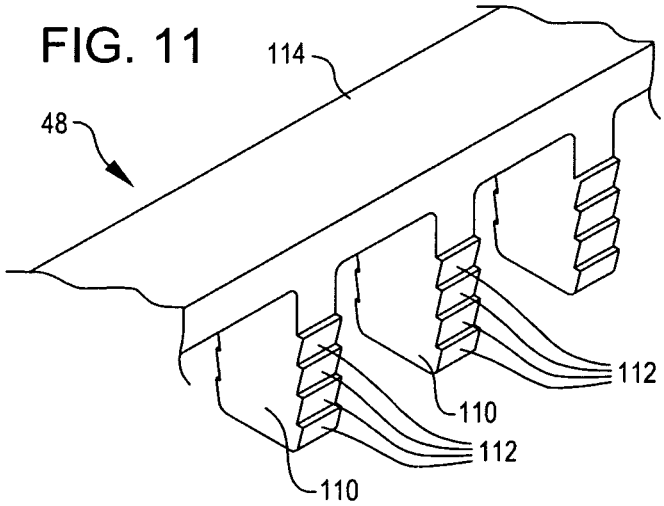
FIG. 11 is a perspective view of the coupler shown in FIG. 10, according to an embodiment of the invention.

FIG. 2 is a perspective, partial cut-away view of a wall 40 and a geogrid 42 coupled to the wall 40, according to an embodiment of the invention. The wall 40 is shown as a retaining wall but may be other types of walls, such as a freestanding wall, and a load bearing wall, both of which, may or may not include a geogrid to stabilize/retain soil or other materials adjacent the wall 40. The wall 40 includes a block 44 (discussed in greater detail in conjunction with (FIGS. 3-5) and a block 46 (discussed in greater detail in conjunction with (FIGS. 7-9), each according to an embodiment of the invention. The blocks 44 and 46 are typically concrete, but may also be or include other materials such as steel or stone. Although the wall 40 is shown to include each of the two different blocks 44 and 46, the wall 40 may include blocks 44 only, or blocks 46 only. The geogrid 42 may be coupled to the blocks 44 (discussed in greater detail in conjunction with (FIG. 6), and to blocks 46 (discussed in greater detail in conjunction with (FIGS. 10 and 11). When the geogrid 42 is coupled to the blocks 44, friction between the geogrid 42 and the lower block 44, and between the geogrid 42 and the upper block 44, which is similar to the lower block 44, holds the geogrid 42 to the wall 40. And when the geogrid 42 is coupled to the blocks 46, a coupler 48 (discussed in greater detail in conjunction with FIG. 11) holds the geogrid 42 to the block 42, and thus the wall 40.

The block 44 includes a top surface 50 that includes a plurality of bosses 52 (here eight but the block 44 may include more or fewer than eight), and a bottom surface 54 that includes a groove 56. As discussed in greater detail in conjunction with FIGS. 3-6, each of the eight bosses 52 includes a summit (reference labels omitted for clarity, but included in FIG. 4), and together the summits define a plane (reference labels omitted for clarity, but included in FIG. 4). The bottom surface's groove 56 has a floor (reference number also omitted for clarity, but included in FIGS. 3, 5 and 6). When the block 44 is placed on another similar block 44 such that the bottom surface 54 of the block 44 and the top surface 50 of the other similar block 44 oppose each other to form an interface region, the groove 56 holds four of the bosses 52, and the groove's floor does not intersect the plane.

Figure 1:
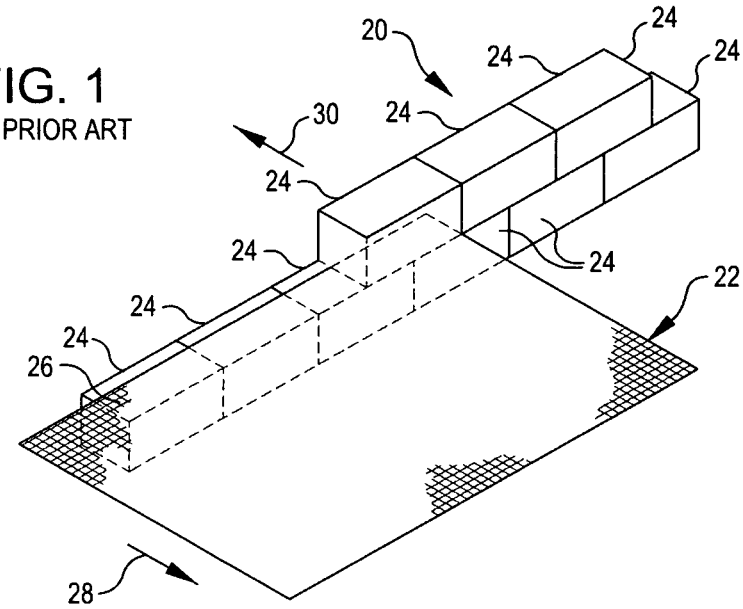
FIG. 1 PRIOR ART
FIG. 1 is a perspective, partial cut-away view of a conventional wall and a geogrid coupled to the wall.

With the bosses 52 held by the groove 56, the force generated by friction between the geogrid 42 and the block 44 that includes the groove 56, and by friction between the geogrid 42 and the other block 44 that includes the bosses 52, is greater than the force generated by friction between the geogrid 22 (FIG. 1) and the conventional blocks 24 (FIG. 1). Because the force generated by friction opposes movement of the geogrid 42 relative to the blocks 44, as the force increases it becomes more difficult for the geogrid to be uncoupled from the wall 40. And with the floor of the groove 56 not intersecting the plane defined by the summits of the bosses 52, more of the geogrid 42 that is placed between the blocks 44 contacts the blocks 44 to generate friction. Furthermore, the geogrid 42 can be disposed between a groove 56 of one block 44 and the boss 52 of another block 44 and remain flat (not curve to form a bump or mound) as the geogrid 42 extends away from the blocks 44.

The force of the friction between the geogrid 42 and the blocks 44 is greater for a couple of reasons. One, the surface area of the geogrid 42 and blocks 44 where the friction is generated is more than the surface area of the geogrid 22 (FIG. 1) and conventional blocks 24 (FIG. 1) where friction is generated. This is because the surface area of each boss 52 is more than the surface area of the boss' footprint on a flat surface. Because the force generated by the friction between the geogrid and the blocks is directly proportional to the surface area where the friction exists, the force increases as the surface area where the friction exists increases. Two, because the bosses 52 extend away from the top surface 50, when the geogrid is pulled away from the wall 40 and friction is generated, pressure that tends to pinch or clamp down on the portion of the geogrid 42 is exerted on the geogrid portion disposed in the groove 56 and contacting the boss 52. Because the force generated by friction between two surfaces is directly proportional to the force that causes the two surface's to contact each other, as the pressure between the geogrid 42, boss 52 and the groove 56 increases, the force generated by the friction also increases.

Still referring to FIG. 2, the block 46 includes a top surface 58 that includes a boss 59 (here four but the block 46 may include more or fewer than four) and a slot 60; a bottom surface 62 that includes a receptacle 64 (here four but the block 46 may include more or fewer than four); and the coupler 48. When the block 46 is placed on another similar block 46 such that the bottom surface 62 of the block 46 and the top surface 58 of the other similar block 46 oppose each other to form an interface region, the receptacle 64 holds the boss 52. As discussed in greater detail in conjunction with FIGS. 10 and 11, a portion of the coupler 48 is inserted through a portion of the geogrid 42 and then into the slot 60 to couple the geogrid 42 to the block 46. With the coupler 48 inserted into the slot 60, the geogrid 42 can be coupled to a block 46 without generating friction between the geogrid 42 and the block 46.

Still referring to FIG. 2, the geogrid 42 can be any desired geogrid. For example in this and certain other embodiments the geogrid 42 is Biaxial Geogrid BX3316 manufactured by Tensar International Corporation that includes a flame-retardant polypropylene polymer. In other embodiments, the geogrid 42 can be Sympaforce® 20/20-20 N manufactured by Synteen & Luckenhaus Textil-Technologie GmbH that includes a PVC coated polyester polymer.

Still referring to FIG. 2, the wall 40 may also include an anchor 66 to help support the wall 40. For example, in this and certain other embodiments of the wall 40 the anchor 66 includes a cable 67 that is fastened to a block 44 of the wall 40, and a base 68 that is disposed in a hole in the ground. To anchor the wall 40, the cable 67 is also fastened to the base 68. Such an anchor is discussed in greater detail in U.S. Pat. No. 5,667,200, issued to Mr. Michael L Kelley Jr. on 16 Sep. 1997, which is herein incorporated. In this embodiment, the anchor 66 exerts a force on the wall 40 in the direction of the arrow 69 when the wall requires such force to resist pressure exerted on the wall 40 in the opposite direction. In other embodiments, the anchor 66 may include a rod (not shown) that when fastened to the block 44 and base 68 can exert a force in the direction of the arrow 69 and in the direction opposite the arrow 69.

Figure 3:
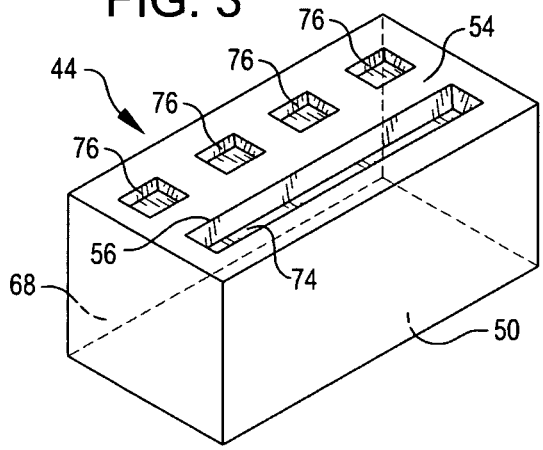
FIGS. 3 and 4 are perspective views of a block included in the wall shown in FIG. 2, according to an embodiment of the invention.
Figure 4:
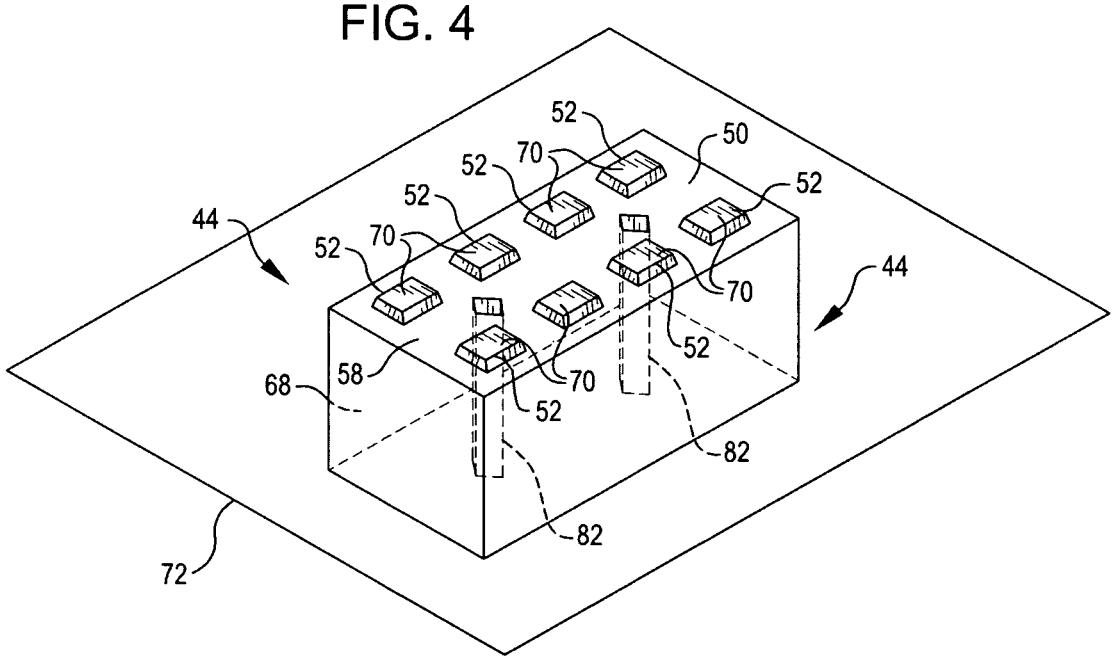
Figure 5:
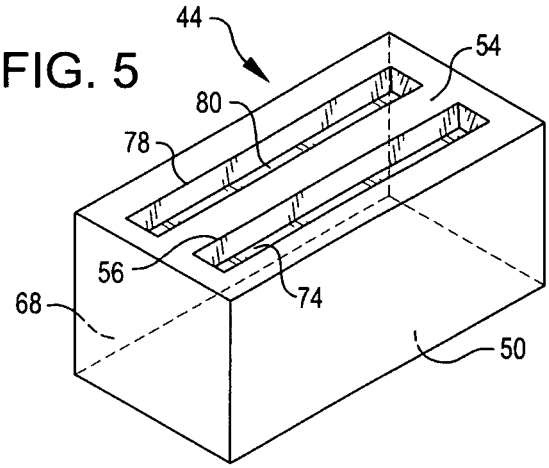
FIG. 5 is a perspective view of a block similar to the block shown in FIG. 4, according to another embodiment of the invention.

FIGS. 3 and 4 are perspective views of the block 44 included in the wall 40 shown in FIG. 2, according to an embodiment of the invention. FIG. 5 is a perspective view of the block 44 that is similar to the block 44 shown in FIG. 4, according to another embodiment of the invention. FIG. 4 shows the top surface 50 of the block 44, FIG. 3 shows a bottom surface 54 that may be included with the block 44, and FIG. 5 shows another embodiment of the bottom surface 54 that may be included with the block 44.

The block 44 includes a front surface 68, the top surface 50 (FIG. 4), and the bottom surface 54 (FIG. 3 or 5). The top surface 50 includes eight bosses 52, and as previously mentioned, the top surface 50 may include more or fewer than eight bosses 52. Each boss 52 includes a summit 70 that together define a plane 72. The bottom surface 54 includes a groove 56 (one in FIG. 3, and two in FIG. 5) that has a floor 74. The groove 56 is configured to receive and hold one or more of the bosses 52 and a portion of the geogrid 42, when the block 44 is placed on top of another similar block 44.

Each of the eight bosses 52 may have any desired configuration. For example, in this and certain other embodiments, each boss has the same configuration, which includes a square pyramid whose top point has been omitted to leave a summit 70 that is substantially flat and parallel with the top surface 50 of the block 44, and located five inches above the top surface 50. The slope of the sides of the square pyramid can be any desired slope that ranges from 0° to 60° relative to vertical. In other embodiments, each boss 52 may have a configuration that is different than some or all of the other bosses 52, such as an oval or trapezoid pyramid. Furthermore, one or more of the bosses 52 may extend more or less than five inches from the top surface 50.

Other embodiments are possible. For example, some of the bosses 52 may include a summit 70 that is more or less than five inches above the top surface 50 of the block 44. An example of such a configuration includes the four bosses 52 positioned in a line that extends along the length of the front surface 68, each having a summit 70 that is six inches above the top surface 50, and the other four bosses 52 positioned along another line parallel to the first line, each having a summit 70 that is five inches above the top surface 50. In such configurations, the summits 70 of the four bosses 52 positioned in a line that extends along the length of the front surface 68 define a second plane, and the summits 70 of the four bosses 52 positioned along the other line parallel to the first line define the plane 72.

The groove 56 may also have any desired configuration that receives and holds one or more corresponding bosses 52 in another similar block 44. For example, in this and certain other embodiments, the groove 56 includes a flat bottom "V" that extends substantially straight along the length of the front surface 68, and whose depth—i.e. the location of the floor 74 relative to the bottom surface 54—is approximately 5.5 inches below the bottom surface 54 and remains substantially constant the length of its extension. By remaining substantially constant along the length of its extension, the floor 74 does not intersect the plane 72 when the block 44 is placed on top of another block 44 and the groove 56 holds four of the eight bosses 52. In this manner, a geogrid may be coupled along the length of a block 44 and remain flat (not curve to form a bump or mound) as the geogrid extends away from the block 44.

Other embodiments are possible. For example, the floor 74 may undulate (not be flat) as the groove extends along the length of the front surface 68.

Still referring to FIGS. 3-5, the bosses 52 may be positioned as desired on the top surface 50. For example, in this and certain other embodiments, four of the bosses 52 may be positioned in a line that extends along the length of the front surface 68, and the other four bosses 52 may extend along another line parallel to the first line. In this configuration, the top surface 50 includes two rows of bosses 52. In other embodiments, more or fewer than four bosses 52 may be positioned in a line that extends along the length of the front surface 68. In still other embodiments, two or more bosses may be positioned in a line that extends along the length of the front service and at an angle relative to the front surface.

Referring to FIGS. 3 and 5, the bottom surface 54 may also include a receptacle 76 (FIG. 3, here four but may be more or fewer than four), or a second groove 78 (FIG. 5). The receptacle 76 may have any desired configuration that receives and holds a respective one of the bosses 52 in another similar block 44. For example, in this and certain other embodiments the receptacle 76 includes a contour having a square pyramid shape and whose bottom is flat, not pointed. The second groove 78 (FIG. 5) may have any desired configuration that receives and holds one or more corresponding bosses 52 in another similar block 44. For example, in this and certain other embodiments, the groove 78 is similar to the groove 56. The groove 78 includes a flat bottom "V" that extends substantially straight along the length of the front surface 68, and whose depth—i.e. the location of the groove's floor 80 relative to the bottom surface 54—is also approximately 5.5 inches below the bottom surface 54 and remains substantially constant the length of its extension. With second groove 78, the geogrid 42 may be disposed between all eight bosses 52 on the top surface 50 (FIG. 4) and in both grooves 56 and 78, to more securely couple the geogrid 42 to the blocks 44.

Other embodiments are possible. For example, the second groove 78 may include a depth that is more or less than approximately 5.5 inches below the bottom surface 54 of the block 44. An example of such a configuration includes the second groove 78 having a depth that is approximately 6.5 inches below the bottom surface 54 of the block 44. This configuration may be desirable to accommodate a block 44 having a row of bosses 52 positioned in a line that extends along the length of the front surface 68, with each of the bosses having a summit 70 that is six inches above the top surface 50 and whose summits 70 define a second plane.

Referring to FIG. 4, the block 44 may also include a grout tube 82 (omitted from FIGS. 3 and 5 for clarity) that one can insert a rod (not shown) through and/or fill with grout or cement (also not shown) to add rigidity to a wall, such as wall 40 (FIG. 2). For example, one can place a block 44 on a cement foundation and have one or more of the foundation's rebars extend from the foundation into the grout tube 82. In this and certain other embodiments, the block 44 includes two grout tubes 82, each extending through the top surface 50, the body of the block 44 and the bottom surface 54, and each having a diamond cross-section. Furthermore, the grout tubes 82 are positioned in the block 44 to allow one of the grout tubes 82 in a first block to align with another one of the grout tubes 82 in a second block 44 that is placed on top of the first block 44 when the two blocks are staggered relative to each other as shown in FIG. 2.

Figure 6:
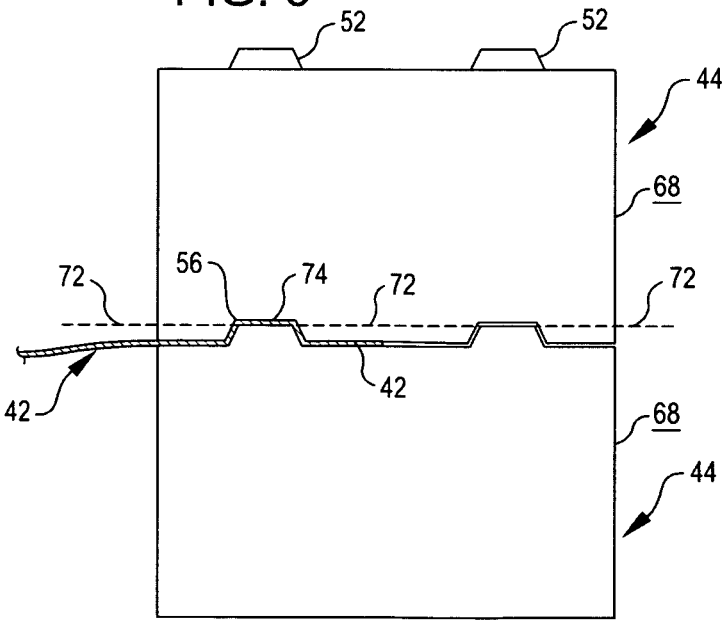
FIG. 6 is a cross-sectional view of a portion of the wall shown in FIG. 2, illustrating two blocks each shown in FIGS. 3 and 4, and a geogrid coupled to them, according to an embodiment of the invention.

FIG. 6 is a cross-sectional view of a portion of the wall shown in FIG. 2, illustrating two blocks 44, each shown in shown in FIGS. 3 and 4, and a geogrid 42 coupled to them, according to an embodiment of the invention. To couple the geogrid 42 to the blocks 44, one first positions the lower block 44 in a desired location. Next, one places a region of the geogrid 42 over one or more of the bosses 52 (here the row of four bosses 52 that extend along a line substantially parallel to the front surface 68). Next one places another similar block 44 on top of the first block 44 and geogrid 42, such that the groove 56 holds four of the bosses 52 and geogrid region, and the four receptacles 76 each hold a respective one of the four remaining bosses 52. If a block 44 having a bottom surface that also includes the groove 78 is placed on top of the other block 44, then the region of the geogrid that is disposed between the blocks 44 can extend to the edge of the front surface 68.

Other embodiments are possible. For example, holes may be cut into the geogrid to allow one or more of the bosses 52 to extend through a respective one of the holes. In such an embodiment, the force generated by friction and the one or more bosses' protrusion through the geogrid 42 holds the geogrid 42 to the blocks 44.

Figure 7:
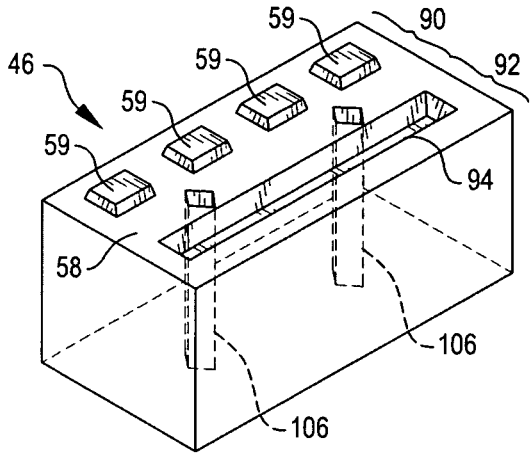
FIGS. 7 and 8 are perspective views of a block included in the wall shown in FIG. 2, according to another embodiment of the invention.
Figure 8:
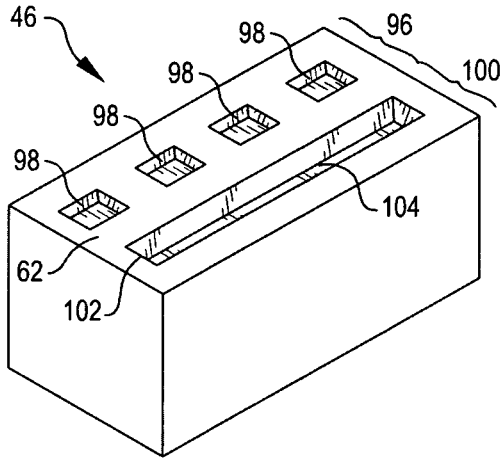

FIGS. 7 and 8 are perspective views of the block 46 included in the wall 40 shown in FIG. 2, according to another embodiment of the invention. FIG. 9 is a perspective view of the block 46 that is similar to the block 46 shown in FIG. 7, according to yet another embodiment of the invention. FIG. 7 shows the top surface 58 of the block 46, FIG. 8 shows a bottom surface 62 that may be included with the block 46, and FIG. 9 shows another embodiment of the bottom surface 62 that may be included with the block 46.

The block 46 includes the top surface 58 (FIG. 7), the bottom surface 62 (FIG. 8 or 9), and the coupler 48 (FIGS. 2, 10 and 11). The top surface 58 includes an anterior region 90 that includes a boss 59 (here four but there may be more or fewer than four), and a posterior region 92 that includes a slot 94. The slot 94 is configured to hold the coupler 48 when the coupler 48 is inserted into the slot 94. The bottom surface 62 has an anterior region 96 that includes a receptacle 98 (four in FIGS. 8 and 9, but there may be more or fewer than four). The receptacle 98 is configured to hold a corresponding boss 59 when the block 46 is placed on top of another similar block 46.

The slot 94 may be configured as desired to receive and hold the coupler 48, and thus, when a portion of the coupler 48 is inserted through a hole (not shown) in the geogrid 42, hold the geogrid 42 to the block 46. For example, in this and certain other embodiments, the slot 94 extends substantially straight across the posterior region 92 in a direction that is perpendicular to the direction of the top surface's anterior region 90 from the slot 94. Furthermore, the slot is approximately 1.5 inches deep and approximately 0.5 inches wide. In other embodiments, the depth of slot 94 may be more or less than 1.5 inches, and the width of the slot 94 may be more or less than 0.5 inches. In still other embodiments, the slot 94 may be located in the anterior region 90 of the top surface 58. In yet other embodiments, the posterior region 92 may include two or more slots 94 positioned side by side and/or fore and aft relative to each other.

Each of the four bosses 59 may have any desired configuration. For example, in this and certain other embodiments, each boss 59 has the same configuration, which includes a square pyramid whose top point has been omitted to leave a substantially flat and parallel surface with the top surface 58 of the block 46, and located five inches above the top surface 58. The slope of the sides of the square pyramid may be any desired slope that ranges from 0° to 60° relative to vertical. In other embodiments, each boss 59 may have a configuration that is different than some or all of the other bosses 59, such as an oval or trapezoid pyramid. Furthermore, one or more of the bosses 59 may extend more or less than five inches from the top surface 58.

The bosses 59 may be positioned as desired on the top surface 58. For example, in this and certain other embodiments, all four of the bosses 59 may be positioned adjacent one or two of the other bosses 59 in a direction perpendicular to the direction of the posterior region 92 from the bosses 59. In other embodiments, the top surface 58 may include more or fewer than four bosses 59. In still other embodiments, one or more of the bosses 59 may be positioned in the posterior region 92 of the top surface 58.

The receptacles 98 may be positioned in the bottom surface 62 as desired, and may have any desired configuration that receives and holds a respective one of the bosses 59 in another similar block 46. For example as shown in FIG. 8, in this and certain other embodiments the receptacles 98 are all positioned in the anterior region 96 of the bottom surface 62, and each includes a contour having a square pyramid shape and whose bottom is flat, not pointed. In another example shown in FIG. 9, four receptacles 98 are positioned in the anterior region 96 of the bottom surface 62, the remaining four receptacles 98 are positioned in the posterior region 100 of the bottom surface 62, and each includes a contour having a square pyramid shape and whose bottom is flat, not pointed.

Referring to FIGS. 7 and 8, the bottom surface 54 may also include a groove 102 (FIG. 8). The groove 102 may also have any desired configuration that receives and holds one or more corresponding bosses 59 in another similar block 46. For example, in this and certain other embodiments, the groove 102 is similar to the groove 56 (FIGS. 2, 3 and 5). The groove 102 includes a flat bottom "V" that extends substantially straight across the posterior region 100 in a direction perpendicular to the direction of the anterior region 96 from the groove 102 along the length of the front surface 68, and whose depth—i.e. the location of the floor 104 relative to the bottom surface 62—is approximately 5.5 inches below the bottom surface 62 and remains substantially constant the length of its extension. By remaining substantially constant along the length of its extension, the block 46 can be used in conjunction with the block 44 to hold a geogrid to the blocks 46 and 44 without requiring the coupler 48.

Other embodiments are possible. For example, the bottom surface 62 may include a second groove in lieu of the four receptacles 98. In such embodiments the bottom surface 62 would be similar to the bottom surface 54 shown in FIG. 5 that includes two grooves.

Referring to FIG. 7, the block 46 may also include a grout tube 106 (omitted from FIGS. 8 and 9 for clarity) that one can insert a rod (not shown) through or fill with grout or cement (also not shown) to hold two or more blocks 46 together. In this and certain other embodiments, the block 46 includes two grout tubes 106, each extending through the top surface 58, the body of the block 46 and the bottom surface 62 (FIG. 9), and each having a diamond cross-section. Furthermore, the grout tubes 106 are positioned in the block 46 to allow one of the grout tubes 106 in a first block to align with another one of the grout tubes 106 in a second block 46 that is placed on top of the first block 46 when the two blocks are staggered relative to each other as shown in FIG. 2.

FIG. 10 is a cross-sectional view of a portion of the wall shown in FIG. 2, illustrating two blocks 46, each shown in FIGS. 7 and 8, and a geogrid 42 coupled to them, according to another embodiment of the invention. To couple the geogrid 42 to the blocks 46, one first positions the lower block 46 in a desired location. Next, one places a region of the geogrid 42 over one or more of the bosses 59 (here the row of four bosses 59 that extend along a line substantially parallel to the front surface 68). Next, one inserts the coupler 48 into a hole (not shown) in the geogrid 42. Then, one inserts the coupler 48 into the slot 94. As discussed in greater detail in conjunction with FIG. 11, the coupler 48 is designed to be inserted into the slot 94 with less pressure than the pressure required to withdraw the coupler 48 from the slot 94. When a force is exerted on the geogrid 42 in a direction away from the blocks 46, the coupler 48 holds the geogrid 42 to resist the geogrid's movement, and the slot 94 holds the coupler 48 to resist in the coupler's movement.

Other embodiments are possible. For example, two or more couplers may be inserted side by side into the slot 94. Or, two or more slots 94 may exist in the top surface 58 of the block 46 and a respective one of a corresponding number of couplers 48 may be inserted into a respective one of the slots 94.

FIG. 11 is a perspective view of the coupler 48 shown in FIGS. 2 and 10, according to an embodiment of the invention. The coupler 48 includes a body 110 (here two shown), an end 112 (here five shown) that extends away from the body, and a bridge 114 that connects the body 110 to other bodies 110 of the coupler 48. To hold the geogrid 42 (FIG. 10) to the block 46 (FIG. 10), the bodies 110 are inserted into a respective one or more holes in the geogrid 42, and then the bodies 110 are inserted into the slot 94. When the bodies are inserted into the slot 94, the ends 112 contact the walls of the slot 94 and exert pressure against them. To make the bodies 110 easier to insert into the slot 94 than to withdraw from the slot, the ends 112 are configured to resist sliding across the walls of the slot 94 when pressure is exerted on the coupler 48 that urges the coupler 48 out of the slot 94.

The coupler may be configured as desired. For example, in this and certain other embodiments, the coupler 48 extends the length of the corresponding slot 94 in the block 46, and has a body 110 positioned in one inch intervals along the length of the coupler 48. Each body 110 is rectangular in shape and a quarter of an inch thick, half an inch wide, and three quarters of an inch long. Each body 110 also includes three ends 112 on each side, and each end 112 includes a scalene triangle profile.

What is claimed is:

1. A block that can be combined with other similar blocks to form a wall, the block comprising:

a top surface having an anterior region that includes a boss, and a posterior region that includes a slot;

a bottom surface having an anterior region that includes a receptacle, wherein when the block is placed on another similar block such that the bottom surface of the block and the top surface of the other similar block oppose each other to form an interface region, the receptacle holds a boss of the other similar block's top surface; and a coupler operable to couple a geogrid to the posterior region of the block when the coupler is inserted into the slot, and including:

a body, and an end extending from the body and configured to slide relative to a wall of the slot when the body is inserted into the slot, and to resist sliding relative to the wall when the body is withdrawn from the slot.

2. The block of claim 1 wherein the block includes concrete.

3. The block of claim 1 wherein the anterior region of the block's top surface includes four bosses, each adjacent one or two of the other bosses in a direction perpendicular to the direction of the posterior region from the boss.

4. The block of claim 1 wherein:

the anterior region of the block's top surface includes four bosses each adjacent one or two of the other bosses in a direction perpendicular to the direction of the posterior region from the boss; and the anterior region of the block's bottom surface includes four receptacles each sized to hold a respective one of the four bosses of another similar block that are included in the other similar block's top surface when the block is placed on the other similar block such that the bottom surface of the block and the top surface of the other similar block oppose each other to form an interface region.

5. The block of claim 1 wherein the receptacle of the bottom surface's anterior region includes a groove sized to receive and hold two or more bosses of another similar block that are included in the other similar block's top surface when the block is placed on the other similar block such that the bottom surface of the block and the top surface of the other similar block oppose each other to form an interface region.

6. The block of claim 1 wherein the slot of the top surface's posterior region extends across the posterior region in a direction that is perpendicular to the direction of the top surface's anterior region from the slot.

7. The block of claim 6 wherein the coupler includes a plurality of bodies and corresponding ends, the bodies arranged relative to each other to extend through a respective hole of a geogrid when the coupler is inserted into the slot.

8. The block of claim 1 wherein the block further comprises a grout tube that extends through the top and bottom surfaces of the block.

* * * * *